United States Patent [19]

Voecks

[11] Patent Number: 4,458,603

[45] Date of Patent: Jul. 10, 1984

[54] STAR GUARD MECHANISM FOR SKI LIFT SYSTEM

[76] Inventor: Larry Voecks, 938 Via Mariposa, San Lorenzo, Calif. 94580

[21] Appl. No.: 302,493

[22] Filed: Sep. 16, 1981

[51] Int. Cl.[3] ..... B61B 12/06

[52] U.S. Cl. ..... 104/182; 74/DIG. 4; 188/267

[58] Field of Search ..... 104/115, 173 ST, 182; 191/76; 74/DIG. 4; 188/267

[56] References Cited

U.S. PATENT DOCUMENTS

| | | | |
|---|---|---|---|
| 2,414,688 | 1/1947 | Chambers | 74/DIG. 4 |
| 3,301,091 | 1/1967 | Reese | 74/DIG. 4 |
| 4,226,187 | 10/1980 | Paulsen et al. | 104/182 |
| 4,265,179 | 5/1981 | Tupper et al. | 104/182 |

FOREIGN PATENT DOCUMENTS

| | | | |
|---|---|---|---|
| 817506 | 9/1937 | France | 104/173 ST |
| 2389523 | 1/1979 | France | 104/182 |
| 2419898 | 11/1979 | France | 104/173 ST |
| 2431945 | 3/1980 | France | 104/182 |
| 504718 | 12/1954 | Italy | 104/182 |
| 86951 | 7/1980 | Japan | 74/DIG. 4 |
| 715856 | 2/1980 | U.S.S.R. | 74/DIG. 4 |

*Primary Examiner*—Randolph Reese
*Attorney, Agent, or Firm*—Bielen and Peterson

[57] ABSTRACT

An improved star guard mechanism for protecting the haul rope of a ski lift system from deropement from the system's carrying sheaves. The guard mechanism is constricted with a guard plate having four radial fingers arranged to cooperate with the cross arm connector of a lift chair gondola or other carrier to rotate the guard plate adjacent the rope carrying sheaves in a turnstile manner providing continuous protection from deropement by at least one of the fingers of the star guard mechanism.

7 Claims, 11 Drawing Figures

STAR GUARD MECHANISM FOR SKI LIFT SYSTEM

BACKGROUND OF THE INVENTION

This invention relates to an improved guard mechanism for the cable of a ski lift system to prevent dislocation or dislodgement of the wire rope from the pulley wheels or sheaves at tower stations. The problem of deropement has become particularly acute in recent years as certain disasters resulting in loss of life have renewed a focus on the safety of lift systems. In particular, this invention is directed to an improved star guard mechanism to prevent deropement at tower stations as the connecting support of the chair or gondola passes over the tower breakover sheaves. The improved star guard has a four finger, self indexing mechanism, with provision for reducing the impact of the horizontal cross bar connecting the wire rope to the chair or gondola support of a lift system.

Because of the frequent problems of icing of the lift system, a guard mechanism should be designed with as few moving parts as possible in order to provide for free rotation of the star guard both during start-up and during operation. Further, due to the obvious inclement weather conditions encountered at the high elevations of ski resorts, a safety system should be constructed to function faultlessly during the most adverse of weather conditions.

Prior systems have been proposed which utilize an auxilliary star guard to the rope carrying sheaves or breakover sheaves. However, such systems have certain defects which can cause a malfunction, that may in fact result in the rope being displaced from the line sheaves which is the very event sought to be prevented.

For example, in star guard systems having more than four fingers or lobes, the clearance provided by the next following finger or fingers with respect to the connecting cross arm of the next advancing chair or gondola, is reduced to an unacceptable level. Further, the angle of attack of the subsequent finger is such that a slight dislocation will render it capable of hitting the advancing cross arm on end with undesirable results. Such systems with more than four fingers have been proposed in Moser, U.S. Pat. No. 4,226,187, issued Oct. 7, 1980, and in Marain et al., French Pat. No. 2,389,523 (1976).

It has been discovered that a four lobe star of proper design can provide all of the guard protection of stars with greater numbers of fingers without the disadvantages of such prior systems. While a four lobe system has been proposed in the past in Lenoble, French Pat. No. 817,506 (1937), the particular configurations of the lobes are such that they are excessively wide, each covering greater than an octant, with blunt ends resulting in diminished clearance between lobes. The wide lobes form an effective attack angle and blunt end that can result in jamming. Additionally, even during normal index positioning the angle of attack on impact of the lobes, tends to lift the actuating cross bar and connected cable, which is undesirable if the guard becomes frozen or locked in position.

Because it is desirable to have the star guard maintained in an indexed preset condition, various devices have been proposed to accomplish this positioning. In the French system of Marian et al. a detent mechanism with a spring loaded ball, acting on grooves in the star guard hub provides for a stepping action on indexing. This mechanism, however, results in excessive drag increasing the impact of the cross bar on the fingers during initial indexing. Further, the mechanism is subject to either jamming or operational failure by icing. Similarly, the French system of Lenoble utilizes a leaf spring and square cam to maintain indexed orientation. This mechanism, being exposed, is also subject to icing and malfunction.

The guard system devised solves the problems of prior systems and provides a four lobe or finger star guard that minimizes the possibilities for failure and minimizes the force of impact of the crossbar with the guard lobes, reducing noise and wear.

SUMMARY OF THE INVENTION

The star guard of this invention is devised for insuring the safety of ski lift systems and may be adapted to existing systems without major difficulty or expense. In general, a ski lift system is constructed with an endless cable or haul rope that is driven by a large horizontal drive sheave or bull wheel generally located at the base of the ski slope. The haul rope is carried by a series of line sheaves on towers strategically located on the slope. At the top of the slope the cable is carried around a horizontal idler wheel mounted on a carriage with a counter-weight connected to the carriage to impart a tension to the haul rope. Because the vertical support member of the chair, gondola or other carrier is connected to the haul rope by clamps or by a spindle interwoven into the wire rope, which is fixed to a short crossbar, the line sheave cannot be capped and must allow for passage of the crossbar. In conventional systems the haul rope is carried on the top of one or more breakover sheaves and held in place by similar depression sheaves positioned over the haul rope, usually between two adjacent breakover sheaves. There remains the infrequent possibility of deropement when the haul rope forces its way through the space between the respective flanges of the depression and breakover sheaves. It is this event which the invented system is devised to prevent.

The star guard mechanism of this invention is constructed with a plate guard and a star guard spacially arranged on each side of the breakover sheave with a clearance that is sufficiently small to render impossible the passage of the haul rope. The plate guard and star guard are rotatably mounted on a spindle carried by a tower mounted bracket, with the spindle having an axis parallel to and vertically aligned with the axis of the rope carrying sheave. At least one sheave and preferably all breakover sheaves on each tower station should be protected with a star guard mechanism.

The star guard of this invention has four symetrically spaced lobes to maximize clearance of the crossbar while at all times protecting the haul rope. The four fingers of the star guard have an enlarged lobe configuration terminating in a point with contoured side cam surfaces suggesting an hourglass shape. This configuration maximizes the space between adjacent fingers and provides for full quarter turn indexing by action of the passing crossbar of the carrier assembly. To minimize the impact force on first contact of the crossbar with the shielding lobe, the cam surface is covered with a rubber-like outer liner, preferably a hard, oil resistent synthetic with high resiliency and low friction characteristics. In addition to cushioning, the impact force is further reduced by the particular configuration of the cam surface with relation to the curvature of the crossbar.

The cam surface is configured at the point of initial contact such that it is at an angle to the corresponding direction of contact of the crossbar thus dividing the impact force vector into normal and shear forces wherein the shear forces cause a slight slip between the contacting members. Wear is minimized by the corresponding arcuate rather than linear travel of the point of contact of the lobe once rotation is initiated.

The cushioning effect can be further enhanced by impregnating the liner material on the cam surface with magnetic material permanently magnetized to oppose a magnetized contact surface on the carrier arm.

Additional reductions in impact forces are achieved by a novel index positioning mechanism which eliminates the need for a spring loaded detent mechanism. By utilizing strategically placed magnet means, the indexed orientation of the star guard can be magnetically maintained in position with minimal impedence restriction to rotation or indexing.

DETAILED DESCRIPTION OF THE PREFERRED EMBODIMENT

Figure 1:
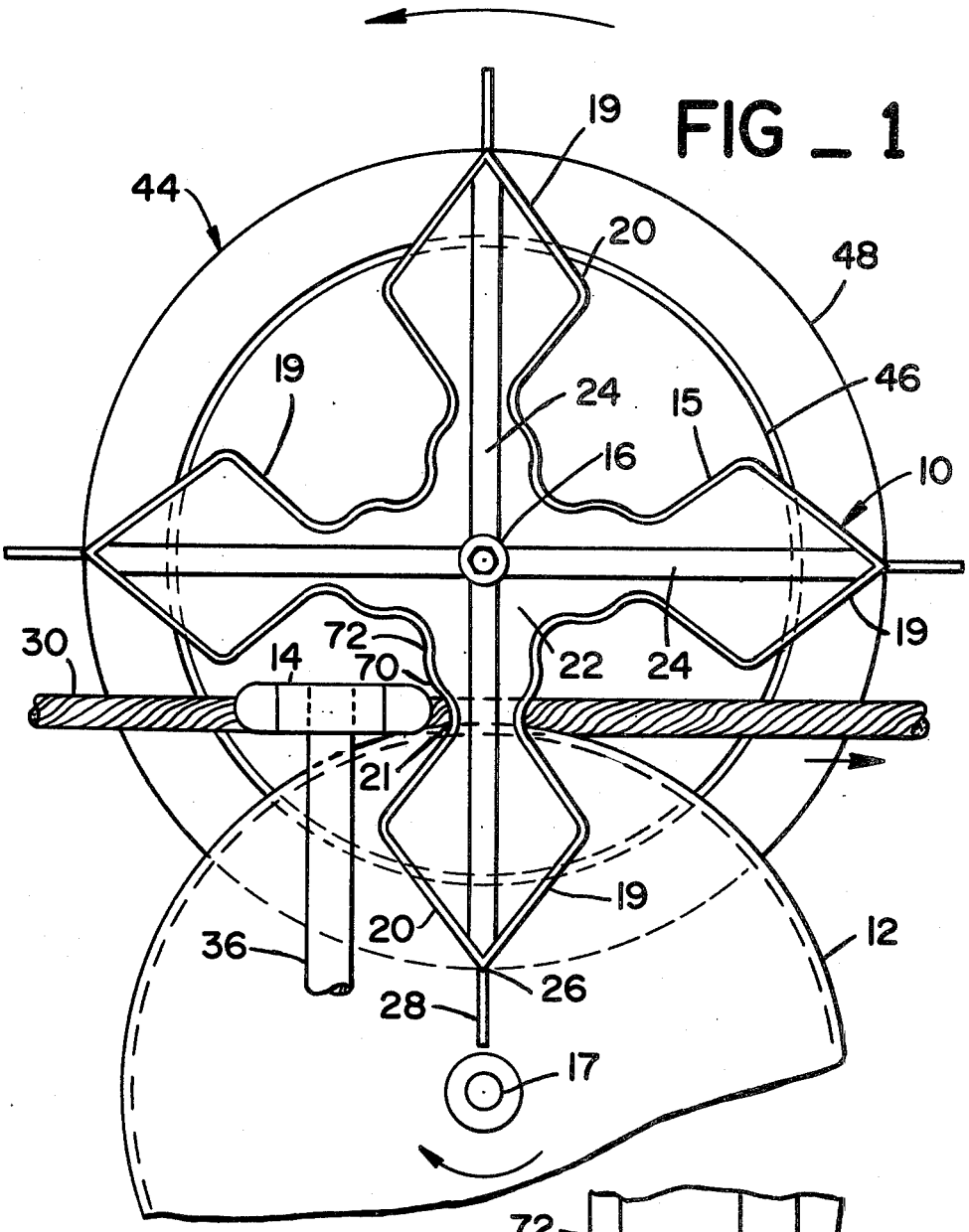
FIG. 1 is a side elevational view, partially fragmented, of the star guard mechanism.

Referring to FIG. 1, the improved guard mechanism, designated generally by the reference numeral 10, is shown positioned with respect to the rope carrying or breakover sheave 12 of a conventional lift system. Only a portion of the lift system is shown, and it is to be understood that the guard mechanism 10 is adaptable to most lift systems where a rope or cable is transported on a plurality of carrying sheaves wherein a number of spaced chairs, gondolas or other carriers are supported from the rope by a support arm connected to the rope. In the embodiment shown in FIGS. 1 and 2, the breakover sheave 12 is designed to operate with a clamp-type cross arm 14 which is generally larger than interwoven connecting systems. Since a clamp-type mechanism requires the fingers or lobes of a star guard system to have the greatest clearance between fingers, a clamp-type mechanism is used in conjunction with the preferred embodiment of the star guard to demonstrate the operational relationship of the guard mechanism with the lift system. Other connecting systems with less stringent clearance requirements are easily adapted to the general configuration of the primary embodiment.

The guard mechanism of FIGS. 1–5 includes a four-finger guard plate 15 with a central spindle axle 16 having an axis of rotation parallel to and vertically above the axis of the axle 17 of the breakover sheave 12. The guard plate 15 is constructed with four radially projecting fingers 19, each with an enlarged, contoured lobe 20 extending from a neck 21 and a central hub portion 22. The guard plate 15 also includes four reinforcing webs 24 symmetrically arranged in a cross pattern on the front and four webs 25 on its back, enabling the principal embodiment to be utilized for heavier carriers such as gondolas or tramways. The contoured lobes are generally diamond shaped terminating in a pointed end 26 with guide rods 28 projecting from the lobe points. The guide rods 28 are made from a spring-like material and are added as a safety feature to insure proper indexing of an improperly oriented guard plate.

Figure 2:
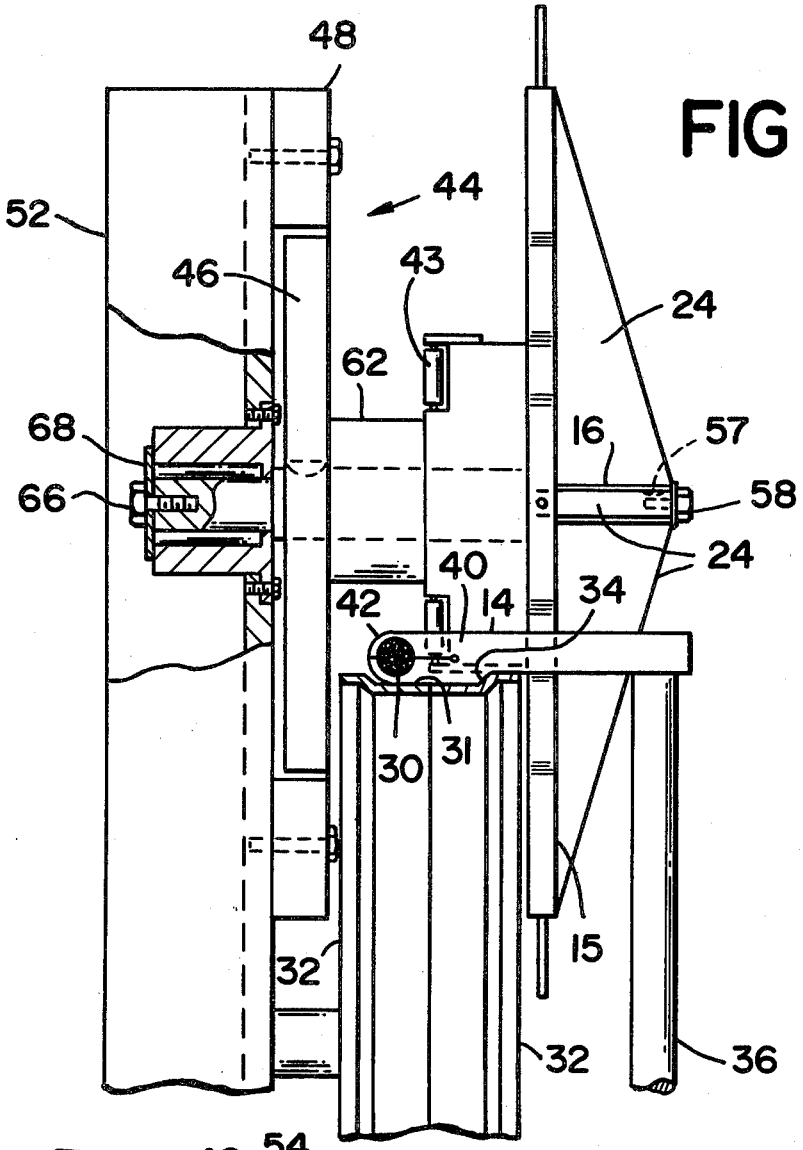
FIG. 2 is an end elevational view of the mechanism of FIG. 1.

The breakover sheave 12 carries the wire rope 30 over its top on a rim liner 31, between two flanges 32 as shown in FIG. 2. In this particular embodiment, the sheave 12 has a wide rim to clear the guide portion 34 of the periodically passing cross arm 14 of the chair or other carrier.

As shown in FIGS. 1 and 2, a support column 36 for a conventional carrier (not shown) is connected to the clamp-type cross arm 14. The cross arm 14 has a clamp segment 40 which includes a split grip 42 connecting the cross arm to the rope 30. The split grip 42 encircles the wire rope 30 and is compressed by a series of clamping bolts (not visible). The design of the support column and carrier is such that the system balance maintains the cross arm 14 in a substantially horizontal position both when the carrier is supported by the rope 30 between rope support stations and when the cross arm is riding over the breakover sheave as shown in FIGS. 1 and 2. Because the cross arm must connect to the haul rope, the rope cannot be protected from deropement by simple enclosure devices used in conventional pulley systems. However, the periodic passage of the cross arm can operate a turnstile device that maintains a protective guard equivalent to an enclosure. Wear from contact of the reinforcing webs 25 of the guard plate 15 with the rope 30 is eliminated by the incorporation of a roller mechanism 43 attached to each web at the point of periodic contact with the rope.

The guard mechanism of this invention utilizes a circular plate unit 44 on one side of the breakover sheave 12 and the star guard plate 15 on the other side. In the principal embodiment of FIGS. 1–3 the plate unit 44 comprises a rotating disc plate 46 connected to the spindle axle 16 which is concentric to an outer annular fixed plate 48. The outer plate 48 is attached by bolts 50 to a connecting bracket arm 52 attached to the support structure of the tower station (not shown) for the rope carrying sheaves.

The inner and outer plates 46 and 48 have strategrically placed permanent magnets 54 which are polarized to attract when the guard plate lobes 20 are in a properly indexed orientation; i.e., vertically and horizontally, and to repel when the lobes are in an improperly indexed orientation; i.e., diagonally. The concentric arrangement of the plates provides an index maintenance means that is less likely to foul as there is no contact between the moving parts that are subject to locking during inclement weather conditions.

Figure 3:
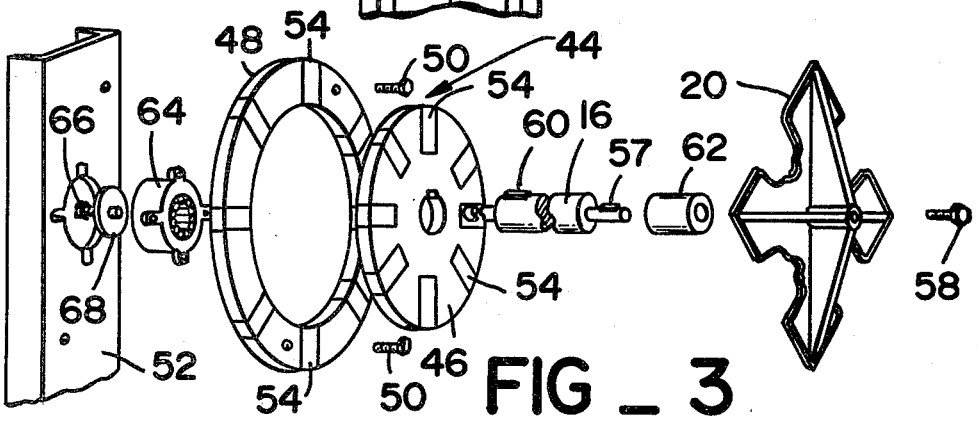
FIG. 3 is an exploded view of the mechanism of FIG. 1.
Figure 5A:
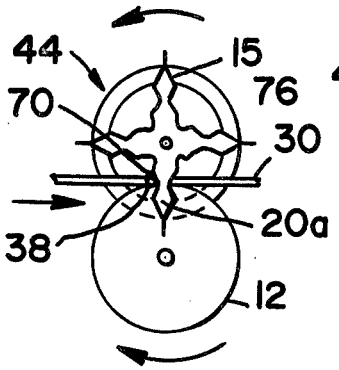
FIGS. 5A–5E are schematic side views of representative positions in a cycle of indexing of the star guard mechanism.
Figure 5B:
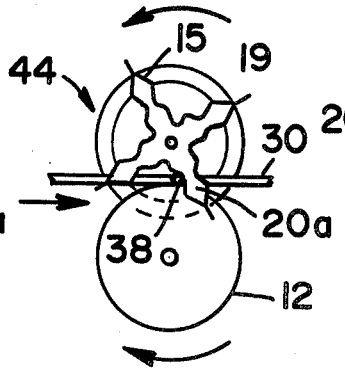
Figure 5C:
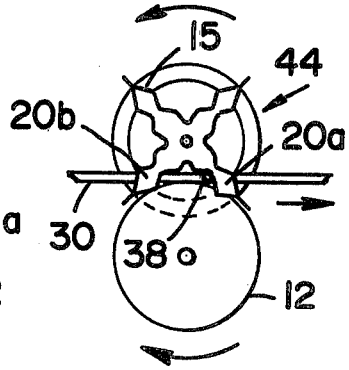
Figure 5D:
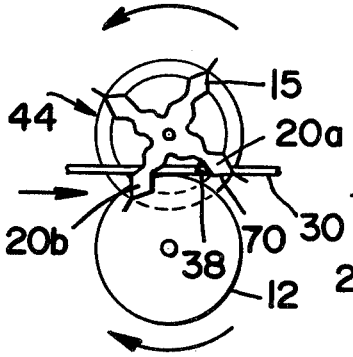
Figure 5E:
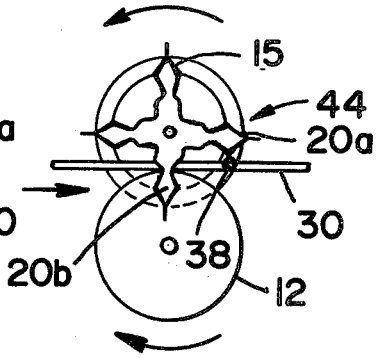

The star guard plate 15 is mounted to the end of the spindle axle 16 and locked to the axle by a key 57 and end bolt 58, as shown in the exploded view of FIG. 3. The disc plate 46 is similarly locked to the axle by a key 60 and positioned by a spacer sleeve 62 and the end of an axle bearing 64 mounted to the bracket arm 52. The spindle axle 16 is connected to the bearing 64 by an end bolt 66 and a capping washer 68 at the back of the bearing. The disc plate 46, spindle and guard plate are freely rotatable with respect to the bracket arm, except for the magnetic inhibition for maintaining index alignment.

In the preferred unit, three impact reduction means contribute to a substantial reduction in the transmitted force of impact. First, the four contoured lobes 20 of the guard plate 15 have a cam surface 70 on which is secured a deformable liner 72, preferably an oil resistant, synthetic rubber. While the material of the liner should be relatively dense or hard to withstand repeated impact as well as shear forces, it should nevertheless have impact absorbing characteristics.

Second, the material of the liner 72 at least in the area of impact is impregnated with a magnetic particle material permanently magnetized in a first polar direction. Alternatively, a permanent magnet mounted in the lobe under the liner will generate a similar effect. The impact head 74 of the cross arm 14 is constructed of a permanent magnet magnetized in a polar direction opposing the material of the liner. Immediately before impact the repelling fields tend to initiate rotation.

Figure 4:
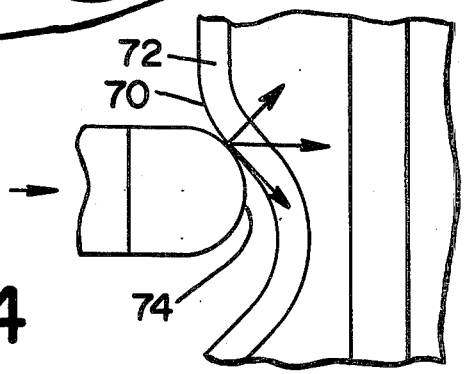
FIG. 4 is an enlarged fragmental view of a cross arm contacting a portion of the star guard mechanism.

Third, the particular contour of the cam surface 70 at the point of initial contact is configured to divide impact forces into perpendicular or normal forces and shear forces. The shear forces are dissipated in a slight sliding action of the impact head 74 on the cam surface 70. The sliding action is minimal as the locus of travel of the point of impact is arcuate rather than linear, being radially fixed from the axis of rotation of the guard plate. The preferred contour in the vicinity of the impact is illustrated in FIG. 4. The mutual tangent line to the curved cam surface and curved impact head is approximately 45 degrees to the line of travel to the cross bar dividing the force vectors as shown. The angle of the tangent line also has the effect of directing reactant forces such that they tend to wedge the cross arm downward against the rope sheave instead of lifting the cross bar as in certain prior art systems. This has the positive effect of maintaining the cross bar and rope against the breakover sheave during indexing.

The operation of indexing is sequentially depicted in the schematic illustrations of FIGS. 5–6. In FIG. 5A, the star guard plate 15 is properly oriented on a horizontal/vertical cross axis just prior to contact with the cross arm 38 attached to the drive rope 30. The lower most lobe **20*a* guards the front side of the breakover sheave 12 and a circular disc plate 76 fully protects the back side of the sheave. As the rope and cross arm travel in a linear horizontal direction, the cross arm contacts the cam surface 70 of the lobe 20*a* and rotates the guard plates as shown by the directional arrows in FIG. 5B. When the contacted lobe 20*a* begins to recede from a protecting position as shown in FIG. 5C, the next following lobe 20*b* moves into a protecting position. The two lobes 20*a* and 20*b* in the orientation of the special plate shown in FIG. 5C share the guarding of the rope when the guard plate is midway between indexed position. As the contact lobe 20*b* assumes the guarding role, the cross arm slides on the cam surface 70 moving to the widest point on the lobe 20*a* as shown in FIG. 5E, causing a fully quarter turn of the guard plates and orienting the star guard plate 15** for the next sequential indexing.

Figure 6A:
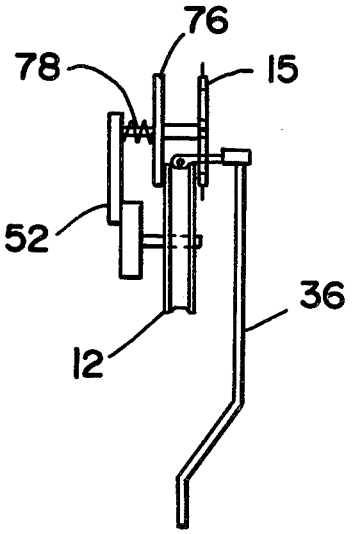
FIGS. 6A and 6B are schematic end views of representative positions in the cycle of indexing of the star guard mechanism.
Figure 6B:
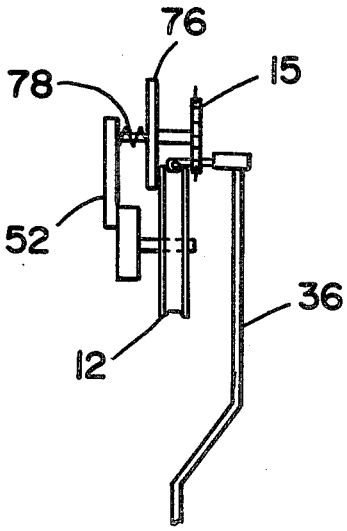

The bracketing effect of the disc plate 76 and guard plate 15 which are mounted to a simplified support mechanism 78 are shown in FIGS. 6A and 6B. The orientation of the guard plate 15 in FIG. 6A corresponds to the horizontal/vertical cross axis orientation of the guard plate in FIG. 5A. Conversely, the orientation of the guard plate 15 in FIG. 6B corresponds to the diagonal cross axis orientation of the guard plate in FIG. 5C.

The improved four finger star guard configuration with contoured lobes allows the necessary clearance between lobes for a narrow cross arm as shown in the FIGS. 5A–E and 6A–B or the wide cross arm of FIGS. 1–3. The pointed ends of the lobes terminating in a bendable rod insure that jamming will be avoided even where a guard plate is inadvertently oriented in a position similar to the plate 15 of FIG. 5B prior to contact with a cross bar. The guard plate will in such position have the contact lobe deflected upward or downward for smooth indexing by the cam surface. The cam surface is included on both sides of each guard lobe to allow for necessary clearances and to permit backward cam indexing in the event the tow rope backslides or is reversed in direction of travel.

While in the foregoing specification embodiments of the invention have been set forth in considerable detail for the purposes of making a complete disclosure of the invention, it should be apparent to those of ordinary skill in the art that numerous changes may be made in such details without departing from the spirit and principles of the invention.

What is claimed is:

1. An improved guard mechanism for a ski lift system in which a wire haul rope having at least one depending carrier structure connected to the rope by a horizontal cross arm is transported on a top portion of at least one carrier sheave with a horizontal axis of rotation mounted to a support structure wherein the guard mechanism is connected to the support structure for operable arrangement with respect to the carrier sheave, the guard mechanism comprising: first and second guard means arranged adjacent each side of the top portion of the carrier sheave for preventing deropement, wherein said first guard means comprises a rotatable star guard plate having an axis of rotation parallel to and vertically above the axis of rotation of the carrier sheave, and having four symmetrically arranged fingers radially projecting from said guard plate axis, said fingers each having a contoured configuration with a neck portion and an enlarged lobe with a pointed terminal end, said neck portion and lobe of each finger being periodically contactable by the horizontal cross arm on transport of the rope and carrier structure on the carrier sheave, wherein a quarter turn rotation of said star guard plate is affected, and at least a portion of one lobe is always located adjacent the side of the top portion of the carrier sheave on rotation, wherein said neck portion and said enlarged lobe have a contoured cam surface adapted to slidably contact the cross arm on rotation of said star guard plate by the cross arm, said contoured cam surface at the location of initial contact by the cross arm being configured to divide contact forces into normal and shear forces, reducing the effective force of impact of the cross arm on contact with said fingers, wherein said contoured cam surface at the point of initial contact is configured at an angle to the corresponding travel direction at contact of the cross arm such that reactant forces on the cross arm tend to wedge the cross arm downward against the carrier sheave to maintain the cross arm and rope against the carrier sheave during indexing.

2. The guard mechanism of claim 1 wherein said second guard means comprises a disc plate.

3. The guard mechanism of claim 2 wherein said disc plate is rotatable in conjunction with rotation of said star guard plate.

4. The guard mechanism of claim 1 wherein said second guard means comprises a disc plate rotatable in conjunction with rotation of said star guard plate and an annular plate concentrically positioned around said disc plate and fixed relative to the support structure wherein said disc plate and said annular plate have mutually interacting magnetic means for temporarily maintaining the rotational orientation of the star guard plate after a quarter turn rotation is effected.

5. The guard mechanism of claim 1 wherein said contoured cam surface and the cross arm have interaction magnetic means generating repelling magnetic fields for reducing the force of impact of the cross arm on contact with said fingers.

6. An improved guard mechanism for ski lift system in which a wire haul rope having at least one depending carrier structure connected to the rope by a horizontal cross arm is transported on a top portion of at least one carrier sheave with a horizontal axis of rotation mounted to a support structure wherein the guard mechanism is connected to the support structure for operable arrangement with respect to the carrier sheave, the guard mechanism comprising: first and second guard means arranged adjacent each side of the top portion of the carrier sheave for preventing deropement, wherein said first guard means comprises a rotatable star guard plate having four symmetrically arranged fingers radially projecting from said guard plate axis, said fingers each having a contoured configuration with a neck portion and an enlarged lobe with a pointed terminal end, said neck portion and lobe of each finger being periodically contactable by the horizontal cross arm on transport of the rope and carrier structure on the carrier sheave, wherein a quarter turn rotation of said star guard plate is affected, and at least a portion of one lobe is always located adjacent the side of the top portion of the carrier sheave on rotation, wherein said pointed terminal end of each lobe includes an elongated projecting flexible element arranged to deflect said lobe upward or downward on contact of said element with the cross arm for resumption of indexing in the event of improper rotational alignment of said star guard plate.

7. An improved guard mechanism for ski lift system in which a wire haul rope having at least one depending carrier structure connected to the rope by a horizontal cross arm is transported on a top portion of at least one carrier sheave with a horizontal axis of rotation mounted to a support structure wherein the guard mechanism is connected to the support structure for operable arrangement with respect to the carrier sheave, the guard mechanism comprising: first and second guard means arranged adjacent each side of the top portion of the carrier sheave for preventing deropement, wherein said first guard means comprises a rotatable star guard plate having an axis of rotation parallel to and vertically above the axis of rotation of the carrier sheave, and having four symmetrically arranged fingers radially projecting from said guard plate axis, said fingers each having a contoured configuration with a neck portion and an enlarged lobe with a pointed terminal end, said neck portion and lobe of each finger being periodically contactable by the horizontal cross arm on transport of the rope and carrier structure on the carrier sheave, wherein a quarter turn rotation of said star guard plate is affected, and at least a portion of one lobe is always located adjacent the side of the top portion of the carrier sheave on rotation, wherein said neck portion and said enlarged lobe have a contoured cam surface adapted to contact the cross arm, said contoured cam surface having a deformable surface liner means for absorbing the force of impact of the cross arm on contact with said fingers.

* * * * *